United States Patent [19]

Eickhoff

[11] Patent Number: 4,971,478

[45] Date of Patent: Nov. 20, 1990

[54] HEIGHT OR LEVEL ADJUSTING DEVICE FOR PLATFORM ASSEMBLY

[75] Inventor: Jon H. Eickhoff, Kalamazoo, Mich.

[73] Assignee: Ronningen Research & Development Company, Vicksburg, Mich.

[21] Appl. No.: 446,920

[22] Filed: Dec. 6, 1989

[51] Int. Cl.[5] ..... E02B 3/20

[52] U.S. Cl. ..... 405/221; 405/218

[58] Field of Search ..... 405/218–221, 405/195–200; 114/263, 266, 267; 182/179, 222; 14/27, 28

[56] References Cited

U.S. PATENT DOCUMENTS

| | | | |
|---|---|---|---|
| 3,345,825 | 10/1967 | Parker | 405/218 |
| 4,212,564 | 7/1980 | Kay | 405/218 |
| 4,349,297 | 9/1982 | Misener | 405/221 |
| 4,352,597 | 10/1982 | Kay | 405/219 |

FOREIGN PATENT DOCUMENTS

| | | | |
|---|---|---|---|
| 0598528 | 5/1960 | Canada | 405/221 |

*Primary Examiner*—Dennis L. Taylor

*Attorney, Agent, or Firm*—Flynn, Thiel, Boutell & Tanis

[57] ABSTRACT

A height or level adjusting device for use with a platform assembly, which platform assembly has a platform section and an upstanding cross brace member oriented between the platform section and a support surface. The cross brace member has a pair of laterally spaced, upstanding extensions thereon. A cross piece support member is provided as is a first mounting structure for facilitating a mounting of the cross piece support member on the cross brace member. A second mounting structure is also provided for facilitating a mounting of the platform section on the cross piece support member. A housing structure is provided at each end of the cross piece support member. Each housing has at least one open side forming an opening into an interior cavity of the housing structure and a bottom wall of the cavity. A pair of laterally spaced adjusting devices are provided on the cross piece support member and include guide structure on each of the housing structures and a plurality of stacked slider members, each movably guided on the guide structure. A movement of at least one of the slide members into the cavity will facilitate it being interposed between the upstanding extension and the bottom wall of the cavity to bring about a height or level adjustment of the platform assembly relative to the cross brace member.

12 Claims, 3 Drawing Sheets

HEIGHT OR LEVEL ADJUSTING DEVICE FOR PLATFORM ASSEMBLY

FIELD OF THE INVENTION

This invention relates to a height or level adjusting device and, more particularly, to a height or level adjusting device for use with a platform assembly, which platform assembly has a platform section and an upstanding cross brace member oriented between the platform section and a support surface.

BACKGROUND OF THE INVENTION

Platform assemblies have been put to a variety of uses, such as stages, risers for choirs and orchestras and even boat docks. In every instance, assembly procedures have proven to be quite time consuming, particularly where the supporting surface, such as the ground, is irregular thereby necessitating a substantial amount of adjustment and leveling to render the platform to its desired elevation. In some platform assemblies where the supporting surface is a flat floor of an exhibition hall, it may be desired to have the platform inclined for purposes of allowing people to walk up a ramp for purposes of facilitating people looking, for example, into the inside of large boats at a boat show without necessitating the people entering the boat. Structure which will facilitate the aforesaid adjustment and leveling tasks is highly desired.

Accordingly, it is an object of this invention to provide a height or level adjusting device for use on a platform assembly, wherein the structure for facilitating the adjustment and/or leveling task is provided as an integral part of the platform assembly.

A further object of this invention is to provide a height or level adjusting device, as aforesaid, which is made of a plastics material, preferably recycled plastics so that the platform assembly can be made of inexpensive materials and be resistant to the abusive affects of weather.

It is a further object of this invention to provide a height or level adjusting device, as aforesaid, wherein the components for effecting the height adjustment or leveling are uniformly constructed throughout the platform assembly.

It is a further object of this invention to provide a height or level adjusting device, as aforesaid, which is easy to use, is durably constructed and is capable of repeated assembly and disassembly in a quick and easy manner.

SUMMARY OF THE INVENTION

The objects and purposes of the invention have been met by providing a height or level adjusting device for use with a platform assembly, which platform assembly has a platform section and an upstanding cross brace member oriented between the platform section and a support surface. The cross brace member has a pair of laterally spaced, upstanding extensions thereon. A cross piece support member is provided as is a first mounting structure for facilitating a mounting of the cross piece support member on the cross brace member. A second mounting structure is also provided for facilitating a mounting of the platform section on the cross piece support member. A housing structure is provided at each end of the cross piece support member. Each housing has an open side forming an opening into an interior cavity of the housing structure and a bottom wall of the cavity. A cross sectional shape of each of the first openings into the cavities as well as the cavities themselves are conformed to a cross sectional shape of each of the upstanding extensions on the cross brace member so as to facilitate reception of the extensions into the cavities. A pair of laterally spaced adjusting devices are provided on the cross piece support member for facilitating an adjustment of the relative position of the cross piece support member on the upstanding extensions of the cross brace member. The adjusting devices include guide means on each of the housing structures and a plurality of stacked slider members, each movably guided on the guide members between a first position removed from the cavity in the housing structure and a second position oriented within the housing structure between the bottom wall of the cavity and the upstanding extension. As a result, a movement of at least one of the slide members to the second position will cause one slide member to be interposed between the upstanding extension and the bottom wall of the cavity to bring about a height or level adjustment of the platform assembly relative to the cross brace member.

BRIEF DESCRIPTION OF THE DRAWINGS

Further objects and purposes of the invention will be apparent to persons of ordinary skill in the art upon reading the following specification and referring to the drawings, in which.

Figure 1:
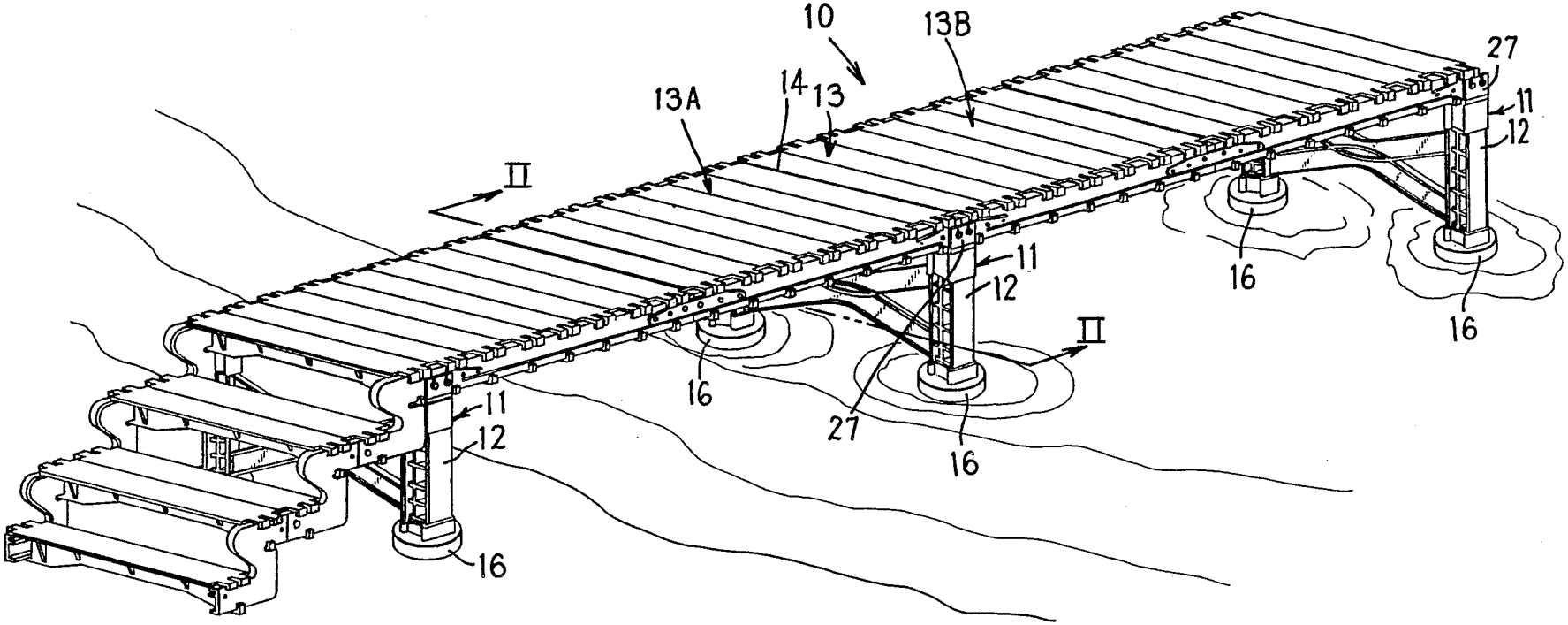
FIG. 1 is a perspective view of a platform assembly, particularly, a section of a boat dock, embodying the invention.

Certain terminology may be used in the following description for convenience in reference only and will not be limiting. The words "up", "down", "right" and "left", if used, will designate directions in the drawings to which reference is made. The words "in" and "out", if used, will refer to directions toward and away from, respectively, the geometric center of the device and the designated parts thereof. Such terminology will include the words above specifically mentioned, derivatives thereof and words of similar import.

DETAILED DESCRIPTION

A platform assembly 10 is illustrated in FIG. 1. Details of the platform assembly are referenced in a copending application Ser. No. 07/446,921, filed Dec. 6, 1989 entitled PLATFORM ASSEMBLY AND ACCESSORIES THEREFOR. Reference to the copending application is to be incorporated herein. A design application Ser. No. 07/446,917, filed Dec. 6, 1989 entitled PLATFORM ASSEMBLY also shows further design details of the platform assembly 10.

More specifically, the invention disclosed in this application relates to a height or level adjusting device generally referenced at 11 in FIG. 1. The height or level adjusting device 11 is adapted to be oriented between a cross brace 12 and a platform section 13 of the aforementioned platform assembly 10. It is preferable that the cross brace 12 be oriented at the juncture between a pair of platform sections 13A and 13B, the line separating the platform sections 13A and 13B from one another being identified by the reference numeral 14. Further details concerning the connection of the cross brace member to the height or level adjusting device 11 will be explained in more detail below. The cross brace 12 has a pair of downwardly extending legs to each of which is secured a pod 16 adapted to rest on a supporting surface, such as the ground. Further details of the design of the cross brace 12 are illustrated in a copending design application Ser. No. 07/446,918, filed Dec. 6, 1989 entitled CROSS BRACE.

Figure 2:
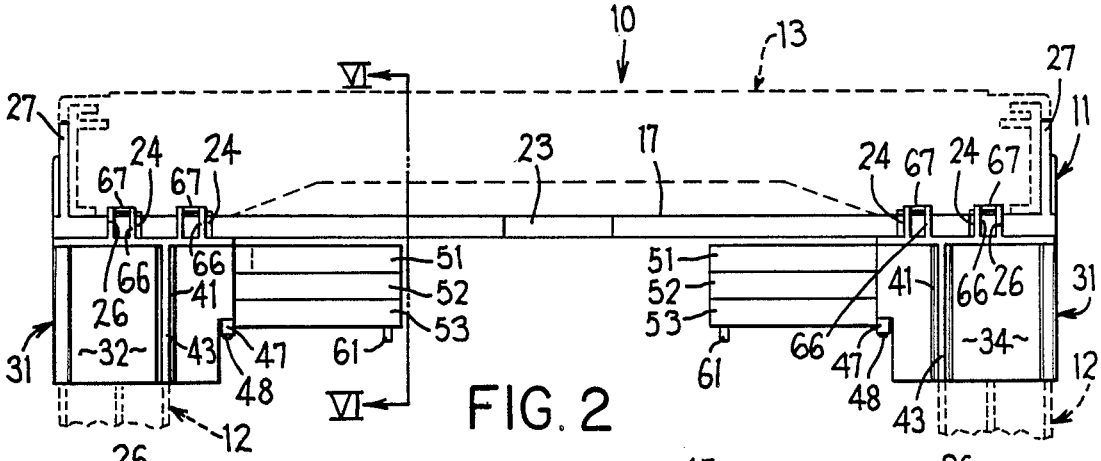
FIG. 2 is a view taken in the direction II—II illustrated in FIG. 1.
Figure 3:
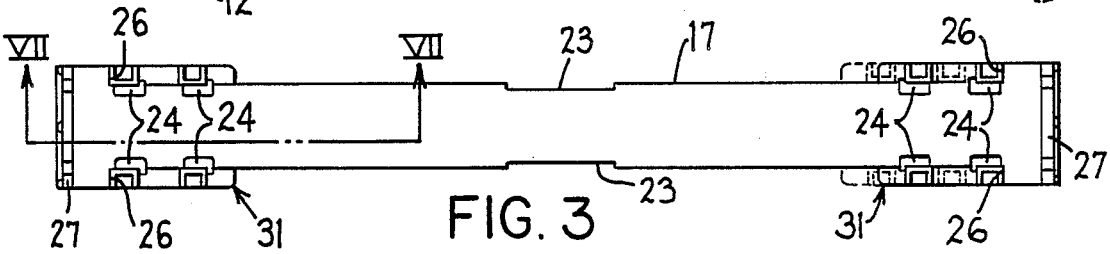
FIG. 3 is a top view of FIG. 2.
Figure 4:
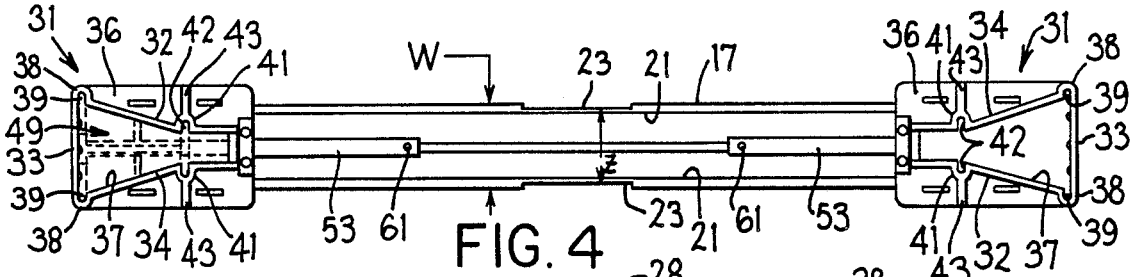
FIG. 4 is a bottom view of FIG. 2.
Figure 5:
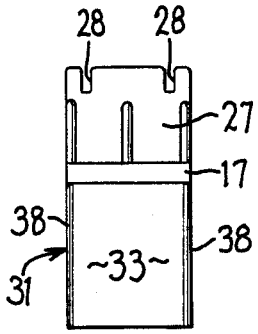
FIG. 5 is a end view of FIG. 2.
Figure 6:
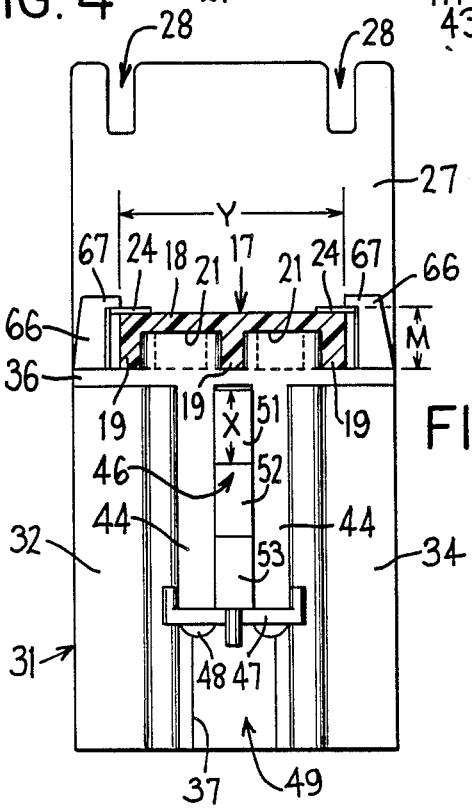
FIG. 6 is a sectional view taken along the line VI—VI of FIG. 2.
Figure 9:
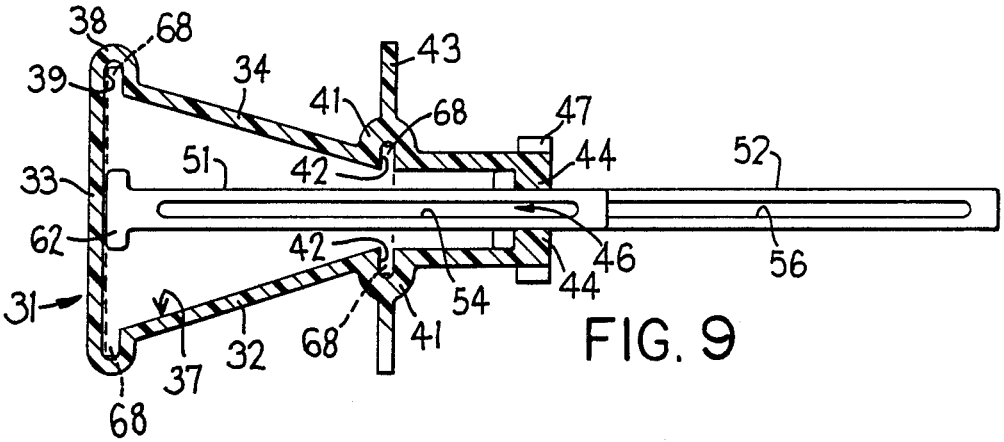
FIG. 9 is a sectional view taken along the line IX—IX of FIG. 7.

FIGS. 2 to 9 illustrate further details of the height or level adjusting device 11. The height or level adjusting device 11 includes a cross piece support member 17 having a generally E-shaped profile as illustrated in FIG. 6, the bight portion 18 of the cross piece support member 17 being generally horizontally oriented with the leg portions 19 extending downwardly therefrom. The space between the mutually adjacent leg portions 19 define grooves 21 extending the full length of the cross piece support member 17. An end wall 22 (FIG. 7) is provided at each end of each groove 21. If desired, a notched out segment 23 can be provided on the outwardly facing side of the two outer most leg portions 19 as illustrated in FIGS. 2–4. The notched out portions 23 are preferably located at the mid-length position for the cross piece support member 17 as shown in FIGS. 2–4. The purpose of the notched out portions 23 will be explained in more detail below.

A pair of raised bosses 24 are provided on each side of the cross piece support member 17 and at each end thereof as well. The raised bosses 24 extend vertically above the bight portion 18 as shown in FIG. 2 as well as laterally thereof as shown in FIG. 3.

Figure 8:
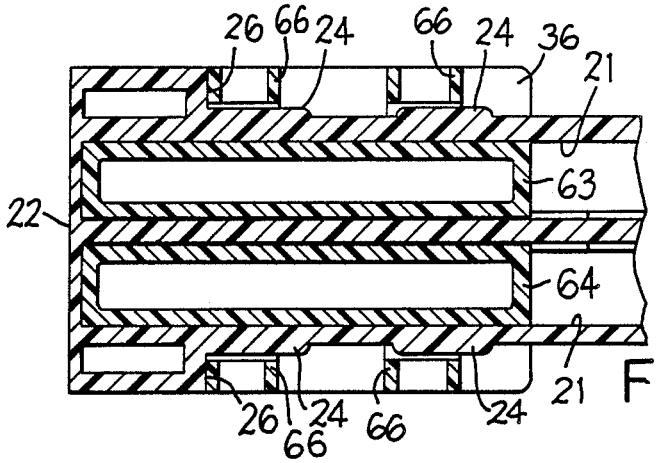
FIG. 8 is a sectional view taken along the line VIII—VIII of FIG. 7.

Abutment surfaces 26 are provided on laterally opposite sides of the cross piece support member 17 at both ends thereof and are spaced inwardly from the end walls 22 as best shown in FIG. 8. In fact, and in this particular embodiment, the abutment surfaces 26 coincide with and are contiguous with a raised boss 24 on each lateral side of the cross piece support member 17.

An upstanding attachment plate 27 is provided at each end of the cross piece support member 17 and is integrally formed therewith. The attachment plates 27 each have a pair of upwardly opening slots 28 therein as shown in FIGS. 5 and 6. As is shown in FIG. 1, each platform section 13A or 13B has a laterally extending bolt adjacent each end and at each lateral side, the shanks of which are adapted to be received into the slots 28. Appropriate nuts and washers are provided on the bolts to facilitate an end-to-end securement of the platform sections 13A or 13B together via the attachment plates 27.

Figure 7:
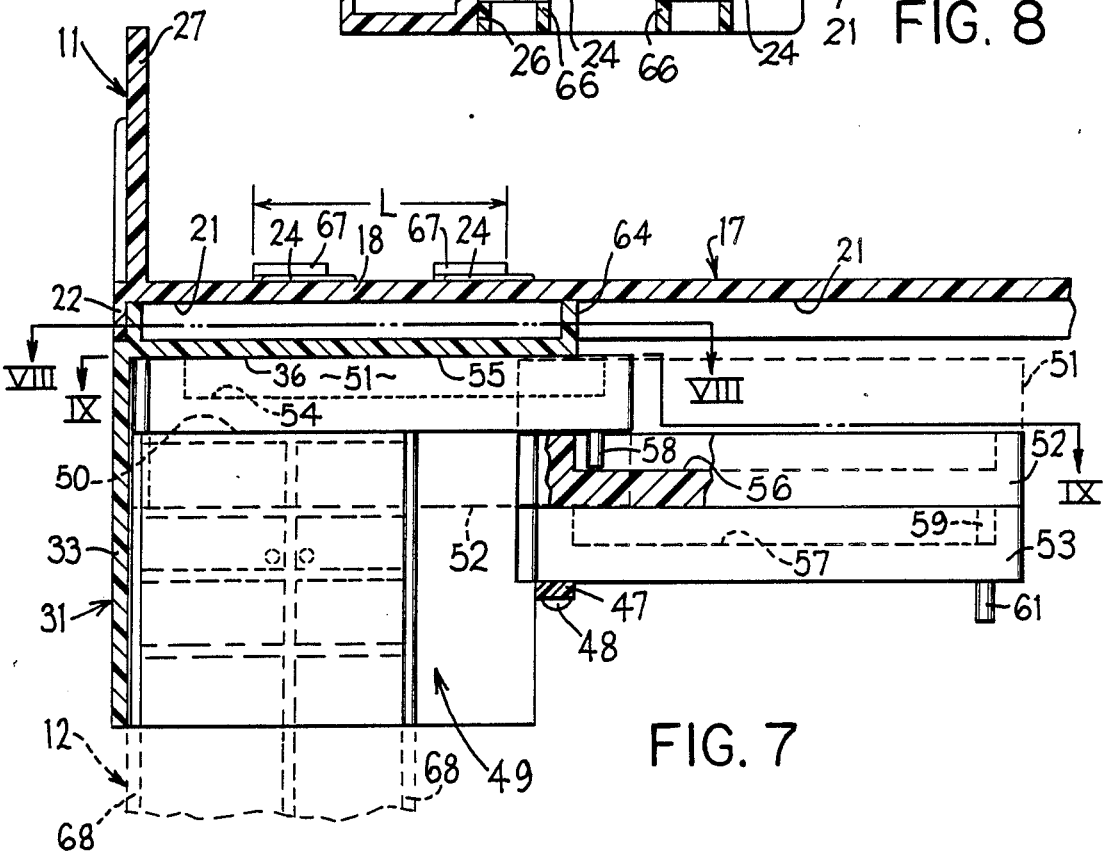
FIG. 7 is a sectional view taken along the line VII—VII of FIG. 3.

A housing structure 31 is provided at each end of the cross piece support member 17 as illustrated in FIGS. 2–4. Each housing structure 31 is preferably identical to one another and has a plurality of side walls 32, 33 and 34 extending downwardly from a generally flat rectangular top plate 36. As is illustrated in FIG. 4, the side walls 32 and 34 converge toward one another from the side wall 33 so as to define a triangular-like, downwardly opening, cavity 37 therebetween. The transition between the side wall 33 and the converging side walls 32 and 34 is a wall segment 38 that has a semicircular cross section so as to define a groove 39 therein communicating with the cavity 37. Furthermore, each of the side walls 32 and 34 have approximately midway along the length thereof a similar semicircular wall segment 41 defining a groove 42 communicating with the cavity 37. The wall segments 38 and 41 provide added strength and rigidity to the side wall construction. In addition, a laterally extending flange 43 extends outwardly from each of the wall segments 41, which flanges 43 extend from the top of each side wall 32 and 34, whereat the flanges 43 are integrally secured to the top plate 36, down to the bottom edge of the side walls. An inwardly extending flange 44 is provided at the end of each of the side walls 32 and 34 remote from the side wall 33, between which flanges 43 is defined a guide way or opening 46. A U-shaped bracket 47 is connected across the bottom edge of the flanges 44 as shown in FIGS. 6 and 7. In this particular embodiment, fastening members 48 are used for the purpose of effecting the securement of the bracket 47 to the lower edges of the flanges 44. Also in this particular embodiment, the length of the flanges 44 are shorter than the length of the side walls 32 and 34 as shown in FIG. 6. The length of the flanges 44 is purely optional and could be longer or shorter if desired.

A plurality of slide members, here three slide members 51, 52 and 53 are vertically stacked on one another and slidably received in the guide way 46 for movement into and out of the cavity 37. Each of the slide members is identical to the other and has a predetermined vertical dimension X (FIG. 6). Further, each of the slide members 51, 52 and 53 is generally rectangular in cross section and has in the top surface thereof a closed ended elongated slot, the slot 54 being shown in FIG. 9 in the upper surface of the slide member 51 as well as the slot 56 in the upper surface of the slide member 52. A similar slot 57 (FIG. 7) is provided in the upper surface of the slide member 53. Further, each slide member has a pin extending downwardly therefrom at a common end of each thereof remote from the housings 31, and as best illustrated in FIG. 7. For example, the slide member 51 has a pin 58 extending downwardly from the bottom surface thereof and a pin 59 extends downwardly from the bottom surface of the slide member 52 and a pin member 61 extends downwardly from the slide member 53. When all of the slide members 51, 52 and 53 are removed from the cavity 37, each of the pins 58, 59 and 61 will be axially aligned with each other and oriented at a common end of each of the elongated slots 54, 56 and 57. Furthermore, and with each of the slide members 51, 52 and 53 removed from the cavity 37, the upwardly extending portion of the cross brace 12 will be allowed to be received into the cavity 37 through the opening 49 into the bottom of the housings 31 and engage the underside of the top wall 36. However, and to facilitate a height or level adjustment, it is possible to lift the cross piece support member 17 with the housing structure 31 attached thereto away from the upwardly extending portion of the cross brace 12 to facilitate the insertion of at least one slide member, for example, the slide member 51 as shown in FIG. 7 between the upper end 50 of the cross brace 12 and the undersurface 55 of the top wall 36. In this regard, the pin 58 will be permitted to slide from one end of the slot 56 in the slide member 52 toward the other end thereof. Furthermore, the orientation of the pins 58 and 59 will prevent an insertion of the lowermost slide member 53 into the cavity 37. That is, at least the uppermost slide member 51 must be moved into the cavity 37 before the next adjacent and lower slide member can be moved into the cavity. The bottom surface of the bottommost slide member 53 slides on the upper surface of the bight portion of the U-shaped bracket 47 and would, when inserted into the cavity, engage the top 50 of the extension on the cross piece 12.

Movement of each of the slide members 51, 52 and 53 into the cavities can be limited by means of the pins 58, 59 and 61 engaging opposite ends of the slots 56, 57 and the edge of the bracket 47 or by means of the inwardly located ends of the slide members, such as the end 62 of the slide member 51, abutting against the inside surface of the sidewall 33 of the housing 31.

The housings 31 are secured to the cross piece support member 17 in the following manner. The top wall 36 of each housing 31 has a pair of upstanding rib constructions 63 and 64 thereon, which rib constructions are of a width so as to be snugly slidably received into the grooves 21 on the underside of the cross piece support member 17. In addition, a set of four inverted L-shaped connector members 66 extend upwardly from the top plate 36 so that the downwardly facing surface of a horizontally extending leg of each L extends over the upper surface of the cross piece support member 17 and, in particular, in a generally coplanar relation to the upwardly facing surface of the raised bosses 24. Referring to FIG. 6, the inverted L-shaped connectors 66 have a horizontally extending leg 67 which overlaps each of the raised bosses 24. In fact, the spacing between the underside of each of the leg portions 67 and the upper surface of the top plate 36 is slightly greater than the corresponding spacing to the top of the raised bosses.

In this particular embodiment, the distance between the oppositely facing left and right edges of the mutually adjacent connector members 67, dimension L in FIG. 7, is preferably just slightly less than the length of the notches 23. Further, the dimension Y (FIG. 6) between the connectors 66 oriented on opposite lateral sides of the top wall 36 is preferably slightly greater than the dimension Z (FIG. 4) between the bottom walls of the notches 23, but equal to or less than the width W of the cross piece support member 17. As a result, the connector members 66, when aligned with the notches 23, will be permitted to move through the notches to bring the rib constructions 63 and 64 into alignment with and reception in the parallel grooves 21 on the underside of the cross piece support member 17. Similarly, the top wall 36 of the housing 31 will be brought into engagement with the bottom edge of each of the leg portions 19 of the cross piece support member. Thereafter, the housing member 31 can be slid lengthwise of the cross piece support member until the connector members 66 closest to the end wall 33 will abut against the abutment surfaces 26 as shown in FIG. 8. At this moment in time, the underside of the leg portions 67 of each of the connector members 66 will overlay the raised bosses 24. The dimension of the raised bosses 24 above the top wall 36 causes the effective dimension M (FIG. 6) between the bottom surface of the leg portions 19 to the top surface of the bosses 24 to exceed slightly the dimension between the top surface of the top wall 36 and the underside of the leg portions 67 of the connector members 66. As a result, the underside of each of the leg portions 67 will snugly frictionally engage the top surfaces of the corresponding bosses to cause the housing members 31 to become frictionally engaged with the cross piece support member 17.

In this particular embodiment, and as is probably apparent based on the above discussion, the cross brace 12 has a pair of laterally spaced, generally triangularly shaped, upstanding extensions that are conformed in shape to the cavity 37 and are adapted to be snugly received into the downwardly facing opening 49 into the cavity 37. In addition, each upstanding extension has on the upper end thereof laterally extending flanges 68 adapted to be received into the grooves 39 and 42 on the inside facing walls of the cavity 37.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A height or level adjusting device for use with a platform assembly, said platform assembly having a platform section and an upstanding cross brace member oriented between said platform section and a support surface, said cross brace member having a pair of laterally spaced upstanding extensions thereon, comprising:

a cross piece support means and first mounting means for facilitating a mounting of said cross piece support means on said cross brace member and second mounting means for facilitating a mounting of said platform section on said cross piece support means;

a housing means at each end of said cross piece support means, said housing means each having means defining at least one open side forming an opening into an interior cavity of said housing means and a bottom wall in said cavity, a cross sectional shape of each of said openings and said cavity associated therewith being conformed to a cross sectional shape of each of said upstanding extensions on said cross brace member so as to facilitate reception of said extensions in said cavities;

a pair of laterally spaced adjusting means on said cross piece support means for facilitating an adjustment of the relative position of said cross piece support means on said upstanding extensions of said cross brace member, said adjusting means including guide means on each of said housing means, and a plurality stacked slide members each movably guided on said guide means between a first position removed from said cavity in said housing means and a second position oriented within said housing means between said bottom wall of said cavity and said upstanding extension;

whereby a movement of at least one of said slide members to said second position will cause said one slide member to be interposed between said upstanding extension of said platform assembly relative to said cross brace member and said bottom wall to bring about a height or level adjustment.

2. The height or level adjusting device according to claim 1, wherein connecting means are provided on said slide members for necessitating a movement of said plural slide members in a predefined sequence to facilitate a placement of first one and then two of said slide members into said second position.

3. The height or level adjusting device according to claim 2, wherein each said slide member has a predefined dimension extending in a direction that is perpendicular to said bottom wall of said cavity.

4. The height or level adjusting device according to claim 1, wherein said housing means has means defining a further opening in a side wall thereof; and wherein said guide means are provided adjacent said further opening, said stacked slide members each having a predefined dimension extending in a direction perpendicular to said bottom wall in said cavity and are guided for movement between said first and second positions relative to said guide means; and wherein connecting means are provided on said slide members for necessitating a movement of said plural slide members in a predefined sequence to facilitate a placement of first one and then two of said slide members into said second position, said connecting means including said slide members being identically constructed, each having an elongated slot on one longitudinally extending side thereof and a pin-like member protruding from a longitudinally extending side opposite said one longitudinally extending side and adapted to be received in said slot when said one and opposite longitudinally extending sides engagingly oppose one another, said pin-like members each being axially aligned and, when received in a slot, oriented at one end of said slot so as to first allow only said slide member adjacent said bottom wall in said cavity to move from said first position to said second position.

5. The height or level adjusting device according to claim 4, wherein, following a movement of said slide member adjacent said bottom wall to said second position, a next adjacent slide member will be allowed to also move to said second position.

6. The height or level adjusting device according to claim 1, wherein said cross piece support means includes an elongated, laterally extending cross piece; and wherein releasable connecting means are provided for releasably coupling said housing means to opposite ends of said cross piece.

7. The height or level adjusting device according to claim 6, wherein said releasable connecting means includes plural inverted L-shaped connectors on said housing means and a pair of notches on said cross piece support means, said inverted L-shaped connectors being alignable with and received in said notches so as to orient an underside of a leg portion of said L-shaped connectors above a top surface of said cross piece support means, a relative longitudinal movement between said housing means and said cross piece support means resulting in a placement of a segment of said inverted L-shaped connector on a side of said cross piece support means remote from said housing means.

8. The height or level adjusting device according to claim 7, wherein said releasable connecting means further includes raised boss means on said top surface of said cross piece support means, said underside of said leg portion engaging said raised boss means to draw said housing means into a tight frictional engagement with said cross piece support means.

9. The height or level adjusting means according to claim 1, wherein all of the components are made of a plastics material.

10. The height or level adjusting means according to claim 8, wherein said plastics material is a recycled plastics material.

11. The height or level adjusting means according to claim 1, wherein said platform assembly is a stage.

12. The height or level adjusting means according to claim 1, wherein said platform assembly is a boat dock.

* * * * *